United States Patent [19]

Purser, Sr.

[11] 4,252,202

[45] Feb. 24, 1981

[54] DRILL BIT

[76] Inventor: James A. Purser, Sr., 595 Village Way, Grand Junction, Colo. 81503

[21] Appl. No.: 63,709

[22] Filed: Aug. 6, 1979

[51] Int. Cl.[3] ..... E21B 10/42

[52] U.S. Cl. ..... 175/412; 175/421

[58] Field of Search ..... 175/412, 382, 383, 384, 175/413, 421

[56] References Cited

U.S. PATENT DOCUMENTS

| | | | |
|---|---|---|---|
| 1,873,814 | 8/1932 | Brewster | 175/412 X |
| 3,075,594 | 1/1963 | Creel | 175/412 |
| 3,099,325 | 7/1963 | Purser, Sr. | 175/412 |
| 3,760,894 | 9/1973 | Pitifer | 175/413 |

*Primary Examiner*—James A. Leppink
*Assistant Examiner*—Richard E. Favreau

[57] ABSTRACT

A drill bit consisting of a tubular, main body member having a set of threads at one end thereof connectable to a drill stem and an annular mounting edge on an opposite end thereof, the mounting edge having a plurality of circumferentially spaced, longitudinally disposed recesses, the main body member having an enlarged annular portion adjacent the annular mounting edge, the enlarged portion of the main body member having a plurality of circumferentially spaced recesses disposed at an angle relative to the axis of the main body member, each of the recesses in the enlarged portion of the main body member being disposed between a set of recesses in the annular mounting edge and providing a pair of converging surfaces, a plurality of blades, each of the blades being disposed in a recess in the mounting edge, substantially radially relative to the axis of the main body member, having a recess receiving a wall portion of the main body member and a surface aligned with a surface of an adjacent set of the sets of converging surfaces, and a locking ring mountable on the main body member, having a plurality of fingers received in the recesses in the enlarged portion of the main body member, engaging a set of converging surfaces thereof and an aligned surface of the adjacent blade member in wedging relation for securing the blade members on the main body member.

10 Claims, 3 Drawing Figures

DRILL BIT

The invention relates to a drill bit and more particularly to a drill bit of the type disclosed in U.S. Pat. No. 3,099,325.

In the aforementioned patent, there is disclosed a drill bit generally consisting of a tubular body adapted to be connected to a drill stem, a set of radially disposed, circumferentially spaced blades mounted on the tubular body and having a set of fingers which engage portions of the blades to secure the blades on the tubular body. Although such type of drill bit has been highly effective in operation, it has been found that under extremely severe drilling conditions, instability of the drill bit has occurred often resulting in breakage. It thus has been found to be desirable to provide an improved design of such type of drill bit which will stabilize the drill bit and prevent breakage thus extending the useful life of the tool.

Accordingly, it is the principal object of the present invention to provide an improved drill bit.

Another object of the present invention is to provide an improved drill bit of the type generally consisting of a tubular body adapted to be connected to a drill stem, a set of circumferentially spaced, radially disposed blades mounted on the free edge of the tubular body and a locking ring mounted on the body and having a set of fingers which engage portions of the blades to secure the blades on the tubular body.

A further object of the present invention is to provide an improved drill bit which will be stabilized under all normal operating conditions.

A still further object of the present invention is to provide an improved drill bit which will remain stable under severe drilling conditions thus avoiding breakage and extending its useful life.

Another object of the present invention is to provide an improved drill bit which is simple in construction, effective in performance and comparatively inexpensive to manufacture.

Other objects and advantages of the present invention will become more apparent to those persons having ordinary skill in the art to which the present invention pertains from the following description taken in conjunction with the accompanying drawings, wherein.

Figure 3:
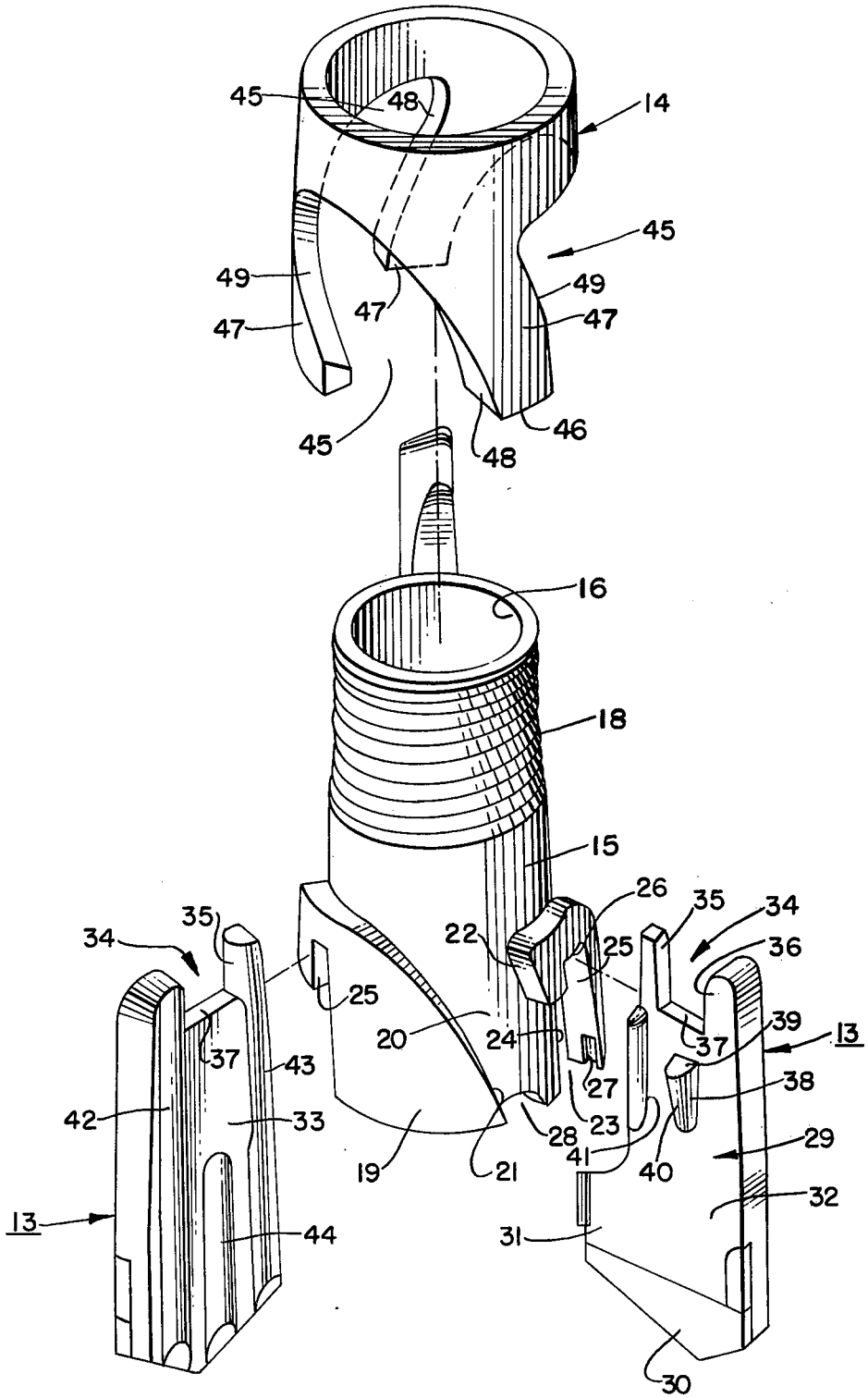
FIG. 3 is a view similar to the view shown in FIG. 1, illustrating the components in exploded relation.

Referring to the drawings, there is illustrated a drill bit 10 which is adapted to be connected to a drill stem 11. The drill bit consists of a main body member 12 connectable to drill stem 11, a plurality of circumferentially spaced, redially disposed blades 13 mounted on the main body member and a locking ring 14 mounted on the body member and engaging the blades to secure them to the main body member. As best seen in FIG. 3, main body member 12 is tubular in configuration, providing an outer cylindrical surface 15, an inner cylindrical surface 16 and an annular mounting edge 17 is provided with a set of threads 18 for threading the drill bit into the lower end of drill stem 11. The end of cylindrical surface 15 opposite the set of threads is provided with an enlarged portion 19 having a plurality of helically configured slots 20, each providing a pair of converging surfaces 21 and 22.

The annular mounting edge 17 is provided with a plurality of circumferentially spaced, longitudinally disposed blade receiving recesses 23. Each of the recesses is disposed between a set of slots 20 and is provided with a pair of sidewalls 24 and 25 and a bottom wall 26. As best shown in FIG. 3, each of recess walls 25 is provided with a notch 27 at the end thereof adjacent annular mounting edge 17. Mounting edge 17 is also is provided with a plurality of circumferentially spaced, shallow recesses 28.

Each of blades 13 has a substantially L-shaped configuration including a main body portion 29, a cutting edge portion 30 and a laterally projecting portion 31. The blade is formed with a front face 32 and a rear face 33. The upper end of each blade is provided with a recess 34 providing a pair of side walls 35 and 36 and a bottom wall 37. Disposed on front face 32 and spaced below bottom wall 37 of recess 34 is a lug 38 having an upper surface 39 disposed substantially parallel to bottom surface 37 of recess 34, and an inclined surface 40. Spaced inwardly from lug 40 and formed along an inner edge of the blade is a ridge or rib 41. Recess face 33 of the blade is provided with a pair of ridges or ribs 42 and 43 formed along the side edges of the blade and a ridge or rib 44 disposed between ribs 42 and 43 and having the upper end thereof terminating below bottom wall 37 of recess 34.

Locking ring 14 consists of an annular member having a plurality of circumferentially spaced recesses 45 in lower edge 46 thereof, providing a set of circumferentially spaced, substantially helically configured fingers 47, each having a pair of converging surfaces 48 and 49. The inside diameter of the locking ring is slightly larger than the outside diameter of main body wall 15 so that the locking ring can be easily mounted on and removed from the upper end of the main body member. Furthermore, the configuration of each of the fingers and the spacing between surfaces 48 and 49 of each finger are such so that when the locking member is mounted on the upper end of the main body member, the fingers will be received in slots 20 of the main body member.

Figure 1:
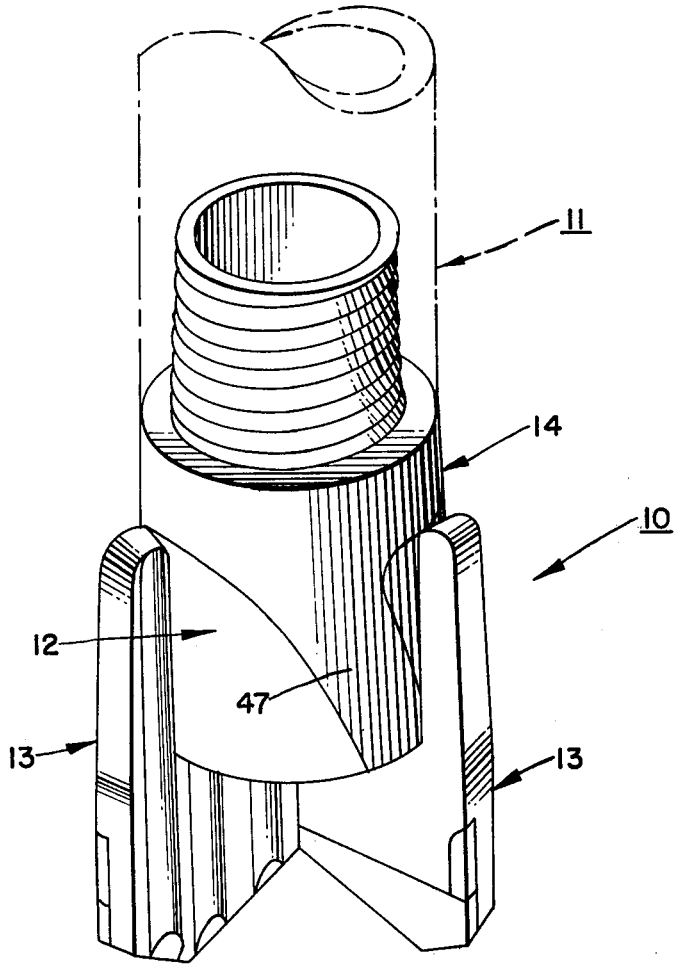
FIG. 1 is a perspective view of an embodiment of the invention.
Figure 2:
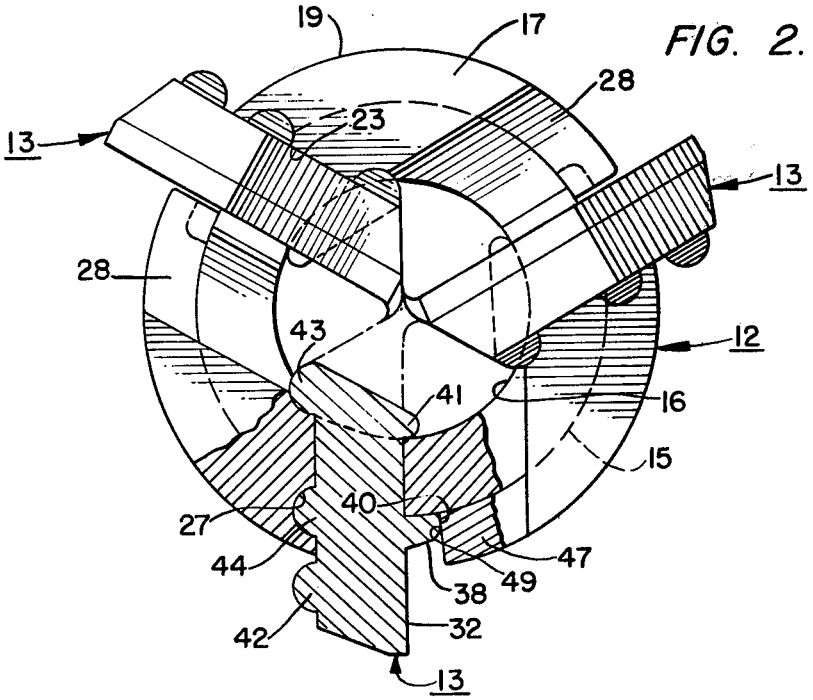
FIG. 2 is an enlarged, bottom view of the embodiment shown in FIG. 1.

To assemble the embodiment as described, each of the blades is mounted on the lower mounting flange of the main body member so that the upper end of the blade is received within a blade receiving recess 23 and the portion of the main body member above a recess 23 is received within recess 34 of the blade. Under such conditions, bottom wall 37 of recess 34 in the blade will engage bottom recess 26 of blade receiving recess 23, side wall 35 of recess 34 will engage inner cylindrical surface 16 of the main body member, side wall 36 of recess 34 will engage a portion of enlarged section 19 of the main body member, front face 32 of the blade will engage side wall 24 of blade receiving recess 23 and rear face 33 will engage side wall 25 of blade receiving recess 23. Also under such conditions, as best seen in FIG. 2, ribs 41 and 43 of each blade will engage inner cylindrical surface 16 of the main body member, the upper end of rib 44 will be received within notch 27 of side wall 25 of the blade receiving recess, and rib 42 will be disposed adjacent the outer surface of the enlarged section of the main body member. When the blade is thus assembled, lug 38 will be positioned adjacent the main body member so that surface 39 is disposed adjacent the enlarged section of the main body portion adjacent a surface 22 and inclined surface 40 thereof will be disposed in alignment with an adjoining surface 22 to form a continuation of such surface 22. The lower, laterally projecting portions 31 of the blades will be disposed adjacent each other along the axis of the main body member with the blades being spaced 120° apart, as best illustrated in FIG. 2.

To secure the blades in position on the main body member, the blades are placed on a support surface, supporting the main body member thereon, and the locking ring is slipped onto the upper portion of the main body member and lowered so that fingers 47 are received within slots 20 of the main body member. When the ring is lowered sufficiently onto the main body member, surfaces 48 of each of the fingers will engage surfaces 20 of slots 20 and surfaces 49 of each of the fingers will engage aligned surfaces 22 and 40 of slots 20 and lugs 38, in wedging relation, to firmly secure the blades and the locking ring to the main body member.

With the drill bit thus assembled, it will be appreciated that the blades will be restrained from movement in a number of directions in about a number of axes. The engagement of surfaces 35 and 36 of blade recess 34 with the main body member, the engagement of ribs 41 and 43 with the inner surface of the main body member, the insertion of the upper end of rib 44 in notch 27 and the engagement of rib 42 with the outer surface of the main body member function to restrain each of the blades from moving laterally or radially, or wobbling about an axis disposed tangent to cylindrical surface 15 of the main body member. The engagement of front and rear faces prevents each blade from moving in along a line disposed tangentially to cylindrical surface 15 of the main body member or wobbling about a radial axis. Furthermore, the engagement of the fingers of the locking ring with lugs 38 of the blades restrains longitudinal movement of each of the blades.

To disassemble the drill bit, the assembly is merely inverted and rested on its threaded end, and the ends of the locking ring fingers may be tapped lightly with a hammer to free the locking ring from its wedging engagement with the main body member and the blades. Once the locking ring has been disengaged, it will drop off of the main body member and the blades may be easily removed by lifting them out of blade receiving recesses 23. Such blades may be replaced with new blades and the drill bit can be reassembled as previously described and quickly placed back into service.

The components of the embodiment as described can be formed of any suitable metals having suitable strength and wear characteristics, and may be fabricated by any suitable method. It is preferred, however, that the main body member and the locking ring be fabricated of a high carbon steel by investment casting and that the blades be fabricated of a high carbon steel by forging. The components also would be subjected to a suitable heat treatment. The threaded portion of the main body member would be formed by conventional machining methods.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A drill bit comprising a main body member having a longitudinally disposed opening therethrough, an end portion threadedly connectable to a drill stem and an opposite end portion defining a peripheral mounting edge, said mounting edge having a plurality of circumferentially spaced recesses, said main body portion having a plurality of circumferentially spaced sets of converging surfaces, each disposed between a set of recesses in said mounting edge, a plurality of blades, each of said blades being displaced in a recess in said mounting edge, having a recess receiving a wall portion of said main body member and a surface aligned with a surface of an adjacent set of said sets of coverging surfaces, and a locking ring mountable on said main body member, having a plurality of fingers, each engaging a set of converging surfaces of said main body member and an aligned surface of an adjacent blade member in wedging relation for securing said blades on said main body member.

2. A drill bit according to claim 1 wherein a side wall of each of said recesses in the mounting edge of said main body member is provided with a notch, and each blade member is provided with a protruding portion received in one of said notches when said blades are mounted on said main body member.

3. A drill bit according to claim 1 wherein each of said blades is provided with a longitudinally disposed ridge engaging an inner wall of said main body member when said blade member is mounted on said main body member.

4. A drill bit according to claim 1 wherein each of said blade members is provided with a tapered lug providing said surface of said blade member engagable with a finger of said locking ring in wedging relation.

5. A drill bit according to claim 2 wherein said tapered lug is spaced from a bottom surface of the recess of said blade member.

6. A drill bit comprising a tubular, main body member having a set of threads at one end thereof connectable to a drill stem and an annular mounting edge on an opposite end thereof, said mounting edge having a plurality of circumferentially spaced, longitudinally disposed recesses, said main body member having an enlarged annular portion adjacent said annular mounting edge, said enlarged portion of said main body member having a plurality of circumferentially spaced recesses disposed at an angle relative to the axis of said main body portion, each of said recesses in said enlaged portion being disposed between a set of recesses in said annular mounting edge and providing a pair of converging surfaces, a plurality of blades, each of said blades being disposed in a recess in said mounting edge, substantially radially relative to the axis of said main body member, having a recess receiving a wall portion of said main body member and a surface aligned with a surface of an adjacent set of said sets of converging surfaces, and a locking ring mountable on said main body member, having a plurality of fingers received in said recesses in the enlarged portion of said main body member, engaging a set of converging surfaces thereof and an aligned surface of said adjacent blade member in wedging relation for securing said blade members on said main body member.

7. A drill bit according to claim 6 wherein a side wall of each of said recesses in the mounting edge of said main body member is provided with a notch, and each blade member is provided with a ridge received in one of said notches when said blade members are mounted on said main body member.

8. A drill bit according to claim 6 wherein each of said blade members is provided with a longitudinally disposed ridge engaging an inner wall of said main body member when said blade member is mounted on said main body member.

9. A drill bit according to claim 6 wherein each of said blade members is provided with a tapered lug providing said surface thereof engagable by a finger of said locking ring in wedging relation.

10. A drill bit according to claim 9 wherein said tapered lug is spaced from a bottom surface of the recess of said blade member.

* * * * *